US009502007B2

(12) United States Patent
Kear

(10) Patent No.: US 9,502,007 B2
(45) **Date of Patent: *Nov. 22, 2016**

(54) DEVICE AND METHOD FOR CUSHIONING THE NECK OF A STRINGED INSTRUMENT

(71) Applicant: David Kear, Pioneer, CA (US)

(72) Inventor: David Kear, Pioneer, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/825,335

(22) Filed: Aug. 13, 2015

(65) Prior Publication Data

US 2015/0348518 A1 Dec. 3, 2015

Related U.S. Application Data

(63) Continuation-in-part of application No. PCT/US2014/057307, filed on Sep. 24, 2014, which is a continuation-in-part of application No. 14/190,031, filed on Feb. 25, 2014, now Pat. No. 9,082,373.

(60) Provisional application No. 61/897,306, filed on Oct. 30, 2013, provisional application No. 61/882,746, filed on Sep. 26, 2013.

(51) Int. Cl.

| | |
|---|---|
| ***G10D 3/06*** | (2006.01) |
| ***G10D 1/00*** | (2006.01) |
| ***G10D 1/08*** | (2006.01) |

(52) U.S. Cl.
CPC ..... *G10D 3/06* (2013.01); *G10D 1/005* (2013.01); *G10D 1/08* (2013.01)

(58) Field of Classification Search
CPC ..... G10D 3/18; G10D 3/00; G10D 1/005; G10D 1/00
USPC ..... 84/267, 290, 293
See application file for complete search history.

(56) References Cited

U.S. PATENT DOCUMENTS 9,082,373 B2 * 7/2015 Kear ..... G10D 3/06

* cited by examiner

*Primary Examiner* — Kimberly Lockett
(74) *Attorney, Agent, or Firm* — IDP Patent Services; Olay M. Underdal

(57) ABSTRACT

A stringed instrument can be manufactured with a neck that contains a back-side soft surface layer and optionally also a front-side soft surface layer, whereby the soft surface layers can increase comfort and enjoyment, and prevent, reduce or alleviate injury during play of the instrument. Alternatively, a stringed instrument can be retrofitted with an installable soft surface component, which can be fitted on top of the surface of the back-side of the neck of the stringed instrument. Further disclosed is a method of using a neck mounted soft surface layer with a stringed instrument.

20 Claims, 6 Drawing Sheets

Soft surface component

DEVICE AND METHOD FOR CUSHIONING THE NECK OF A STRINGED INSTRUMENT

CROSS-REFERENCE TO RELATED APPLICATIONS

This United States Non-Provisional application is a continuation-in-part of International PCT Application No. PCT/US14/57307, filed Sep. 24, 2014, which claims the benefit of U.S. Non-Provisional application Ser. No. 14/190,031, filed Feb. 25, 2014; U.S. Provisional Application No. 61/897,306, filed Oct. 30, 2013; and U.S. Provisional Application No. 61/882,746, filed Sep. 26, 2013.

FIELD OF THE INVENTION

The present invention relates generally to the field of playing on stringed instruments, which have a neck, and more particularly, to methods and devices to avoid discomfort, fatigue and injury to hands and fingers, while playing such instruments.

BACKGROUND OF THE INVENTION

Stringed instruments of the lute type, such as all types of guitars, bass guitars, and other stringed instruments in which the strings are supported by a neck, are characterized by a first hand regulating the sounding length of the strings, and the other hand plucking or bowing the strings to produce a sound, with the pitch adjusted by the established sounding length of the strings.

The movement and force needed to establish chords or tones with the first hand are swift, and may need significant application of force. During play, musicians may experience various degrees of discomfort and fatigue of the hands and fingers, and may suffer temporary or chronic localized numbness, for example of the entire area of the thumb that comes into contact with the neck of the stringed instrument. In some cases, debilitating injuries may manifest, such as related to tendonitis, carpal tunnel syndrome, nerve compression injuries and various forms of repetitive strain injuries. Such injuries can be sufficiently serious that they can halt or entirely terminate the career of a professional musician.

Various warm-up, preparation, and playing techniques have been proposed in the past, and are in use currently, to prevent such injuries, and a number of well-known treatment methods can be used once an injury has manifested. However, up until now, there are no known devices and associated methods available that can directly prevent, reduce, or alleviate injuries while playing a stringed instrument.

As such, considering the foregoing, it may be appreciated that there continues to be a need for novel and improved devices and methods for treatment of trigger points.

SUMMARY OF THE INVENTION

The foregoing needs are met, to a great extent, by the present invention, wherein in aspects of this invention, enhancements are provided to the existing model of playing on stringed instruments.

In an aspect, the neck of a stringed instrument, can have a soft surface, so that the surface is manufactured with, or enhanced with, a cushioned or padded surface, which reduces fatigue to the hand and thumb while playing on the stringed instrument, and can prevent or alleviate injury, and in general provide a more enjoyable, comfortable, and pleasurable music playing experience.

In a related aspect, a stringed instrument can be retrofitted with an installable soft surface layer, which can be installed on top of the surface of the back-side of the neck of the stringed instrument.

In another related aspect, a stringed instrument can be manufactured with a neck that contains a back-side soft surface layer, and optionally also a front-side soft surface layer.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
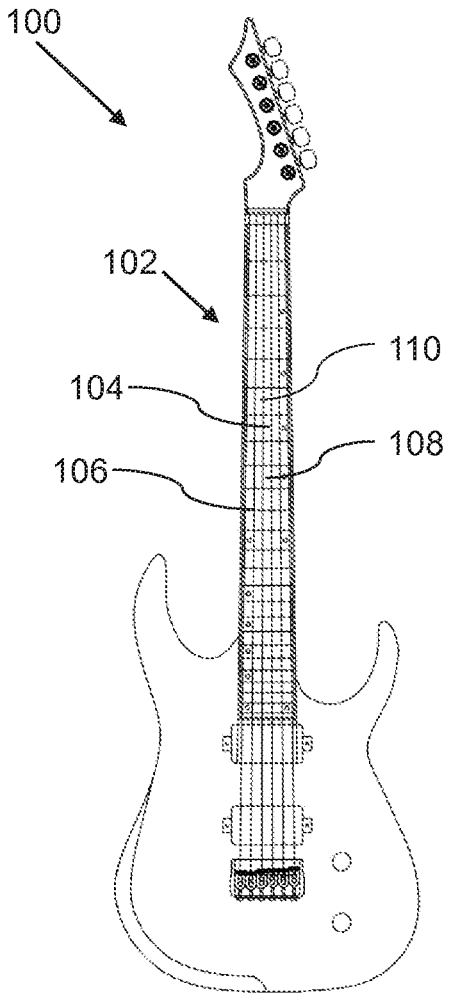
FIG. 1 is a front view of a stringed instrument with a soft surface neck, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Throughout this disclosure, a stringed instrument shall be understood to include stringed instruments of the lute type, with a neck, further containing on the front-side a fingerboard, and optionally frets. Examples of such stringed instruments include, in their various forms, the guitar, electric bass, double bass, sitar, rabab, violin, viola, cello, banjo, mandolin, ukulele, etc.

A stringed instrument is played by a first hand regulating the sounding length of the strings, and a second hand plucking or bowing the strings to produce a sound, with the pitch adjusted by the established sounding length of the strings.

In the following, we describe the structure of embodiments with reference to the figures, in such manner that like reference numerals refer to like components throughout.

Figure 2:
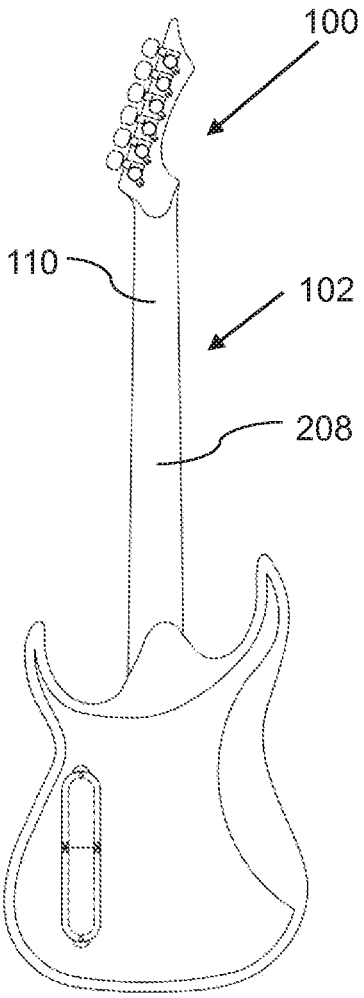
FIG. 2 is a back view of a stringed instrument with a soft surface neck, according to an embodiment of the invention.

In an embodiment of a stringed instrument with a soft surface neck 100, as illustrated in FIGS. 1 and 2, the neck 102 of a stringed instrument, can have a soft surface layer 110, wherein the surface of the neck 102 is manufactured with, or retrofitted with, a cushioned or padded surface, whereby the neck 102 retains its full strength and stiffness, and the cushioned or padded surface reduces fatigue in the first hand, including the fingers and the thumb of the first hand, and can prevent, reduce, or alleviate injury, during long-term use of the stringed instrument. Additionally, the soft surface layer 110 may provide a more enjoyable, comfortable, and pleasurable music playing experience.

In a related embodiment, as shown in FIG. 1, a stringed instrument with a soft surface neck 100 can have a soft surface layer 110 on the front-side of the neck 108 of the stringed instrument. For a stringed instrument with frets 106, the soft surface layer 110, can be in the fingerboard area between the frets 106, such that the frets are elevated above the soft surface layer 110.

In a related embodiment, as shown in FIG. 2, a stringed instrument with a soft surface neck 100 can have a soft surface layer 110 on the back-side of the neck 208 of the stringed instrument.

In various embodiments, the soft surface layer 110 can have a surface of various degrees of suitable friction, to allow a musician to move the hand freely and swiftly without friction from chord position to chord position, while allowing a chord position to be established without losing grip.

In related embodiments, the soft surface layer 110 can be made of foam materials, leather, natural or synthetic rubber, silicone, gel cushioning material, soft plastic, or other suitable soft material. Foam materials can include open or closed cell flexible polyurethane foam, memory foam, viscoelastic polyurethane foam, and similar foam materials. Foam materials can further include microcellular plastic foam, including flexible microcellular urethane foam and flexible microcellular polyurethane foam, with an average cell size in a range of 10-200 micrometer.

In a related embodiment, the soft surface layer 110 can be manufactured with an outer surface friction designed to be similar to the friction of the back-side surface of an instrument neck. For example, for a specific brand and model of a guitar, the soft surface layer can be manufactured with a surface friction designed to match the specific surface friction of the guitar neck back-side.

In various embodiments, the soft surface layer 110, can extend throughout the entire length of the neck of a stringed instrument, or can be designed to cover only a part of the neck, for example covering only the upper part, of the back-side of the neck 208, or in another example covering the entire length of the back-side of the neck 208, but covering only the upper half of the front-side of the neck 108, and only in the areas of the fingerboard surface 104, that are in between the frets 106 of a stringed instrument with a neck and frets.

In various embodiments, depending on application and the type of stringed instrument, the soft surface layer 110 can be configured with a thickness in a range from 0.01 to 40 mm. Alternatively the soft surface layer 110 can be configured with a thickness in other ranges, such as 0.01 to 35 mm, 0.1 to 40 mm, or 0.5 to 5 mm. The thickness can vary according to preference and the type of material used, and may be substantially lower or higher than these ranges.

In various embodiments, the hardness of the soft surface layer 110, as measured on the Shore durometer type A hardness scale, can be in the range of 10 to 80, which is a dimensionless scale in accordance with the ASTM D2240 Type A specification. A suitable hardness can vary according to preference, and may be substantially lower or higher than this range.

For example in some applications, the soft surface layer 110 can be configured with a Shore durometer type A hardness in a range of:

a. 10 to 20;
b. 15 to 25;
c. 25 to 35;
d. 35 to 45;
e. 45 to 55;
f. 55 to 65;
g. 65 to 70;
h. 40 to 70; or
i. A combination of these.

In various embodiments, the hardness of the soft surface layer 110, as measured on the Shore durometer type O hardness scale, can be configured in the range of 8 to 84, which is a dimensionless scale in accordance with the ASTM D2240 Type O specification. A suitable hardness can vary according to preference, and may be substantially lower or higher than this range.

For example in some applications, the soft surface layer 110 can be configured with a Shore durometer type O hardness in a range of:

a. 8 to 28;
b. 21 to 35;
c. 28 to 42;
d. 35 to 48;
e. 42 to 53;
f. 48 to 57;
g. 53 to 61;
h. 57 to 65;
i. 61 to 69;
j. 65 to 72;
k. 69 to 75;
l. 72 to 79;
m. 75 to 84; or
n. A combination of these.

In various embodiments, durometer may be varied according to thickness of the soft surface layer 110, such that a thinner soft surface layer 110 is normally configured with a harder soft surface layer 110, such that for example:

a. a soft surface layer 110 with a thickness in a range of 0.1 to 1.0 mm can be configured with a durometer type O hardness in a range of 35 to 75;
b. a soft surface layer 110 with a thickness in a range of 1.0 to 2.0 mm can be configured with a durometer type O hardness in a range of 14 to 42; and
c. a soft surface layer 110 with a thickness in a range of 2.0 to 3.0 mm can be configured with a durometer type O hardness in a range of 8 to 21.

In various embodiments, a soft surface layer 110 can be configured with a varying density, such that the inner core soft material 704 has a higher density on an inner side 712 and a lower density on an outer side 714. Such a configuration can for example be manufactured with a plurality of different layers that are adhered or bonded together, or can be made as an integral piece during manufacturing.

In various embodiments, a soft surface layer 110 can be configured with a varying hardness, such that the soft surface layer 110 is harder on an inner side and softer on an outer side. Such a configuration can for example be manufactured with a plurality of different layers that are adhered or bonded together, or can be made as an integral piece during manufacturing.

In various embodiments, as shown in FIG. 2, depending on application and the type of stringed instrument, the elasticity and hardness of a soft surface layer 110 on the back-side of the neck 208 of a stringed instrument may allow for an indentation in the area of pressure from thumb or hands, normally in a range of 0.1 to 3 mm, during application of maximum force while playing on the stringed instrument. This range may vary according to preference and can be substantially wider, such as up to 6 mm or more. The indentation can for example be such that a soft surface layer 110 can be compressed up to 50-95% or more of its thickness, during application of maximum force while playing on the stringed instrument, as compared to the normal thickness without application of force. A soft surface layer 110 can for example be compressed up to 95%, such that a normal thickness of 3 mm is compressed down to 0.15 mm. The soft surface layer 110 will for most applications substantially regain its original surface shape swiftly after application of force is ended on a localized area of the soft surface.

In various embodiments, as shown in FIG. 1, depending on application and the type of stringed instrument, the elasticity and hardness of a soft surface layer 110 on the front-side of the neck 108 of a stringed instrument may allow for an indentation in the area of pressure from thumb or hands, of up to a maximum range of 0.01 to 3 mm, during application of maximum force while playing on the stringed instrument. This range may vary according to preference and can be substantially wider, such as up to 6 mm or more. The indentation can for example be such that a soft surface layer 110 can be compressed up to 50-95% or more of its thickness, during application of maximum force while playing on the stringed instrument, as compared to the normal thickness without application of force. A soft surface layer 110 can for example be compressed up to 95%, such that a normal thickness of 3 mm is compressed down to 0.15 mm. The soft surface layer 110 will for most applications substantially regain its original surface shape swiftly after application of force is terminated on a localized area of the soft surface.

In an example embodiment, a soft surface layer 110 for a guitar can be manufactured using a microcellular polyurethane foam, with a thickness of substantially 1.5 mm and a Shore durometer type O hardness of substantially 24. Such a foam can for example be of the following specific make and model: Poron FMA 20059®™, manufactured by Rogers Corp.

In an embodiment, the soft surface can cover only the back-side of the neck of a stringed instrument, covering up until the side of the back-side of the neck reaches the side of the fingerboard, whereby the soft surface protects the thumb and the hand of a musicians first hand.

Figure 5:
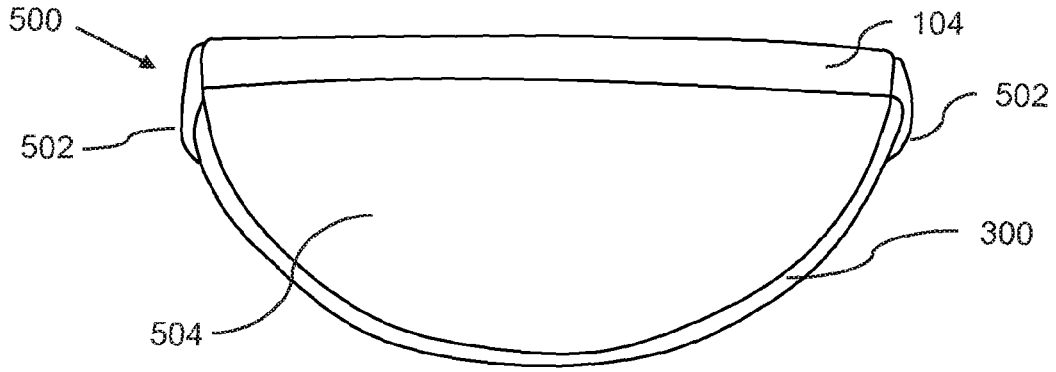
FIG. 5 is a cross-sectional centerline view of the neck of a stringed instrument, retrofitted with an installable soft surface component, according to an embodiment of the invention.
Figure 6:
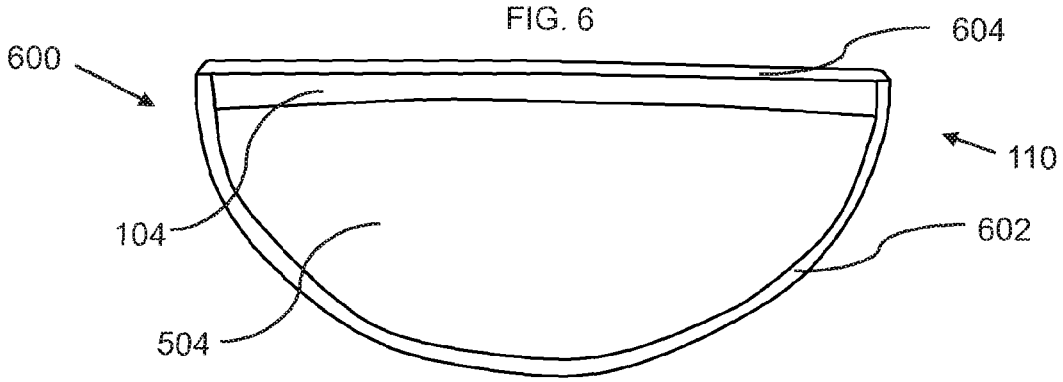
FIG. 6 is a cross-sectional centerline of the neck of a stringed instrument neck manufactured with a back-side soft surface layer and a front-side soft surface layer, according to an embodiment of the invention.

In an embodiment, illustrated in FIG. 6, a stringed instrument with a soft surface neck 100 can be manufactured with a neck 600 wherein the soft surface layer 110, includes a back-side soft surface layer 602 and optionally also includes a front-side soft surface layer 604. Such a neck can for example be manufactured with a composite structure, wherein an inner core of the neck, comprising a neck body 504, and a fingerboard 104, is manufactured as a guitar neck, as illustrated in FIG. 5, but slightly thinner and stronger, to accommodate a soft surface layer, while still retaining normal outer dimensions for the stringed instrument. This soft surface layer 602 604 can for example be sprayed on in the form of a sprayable hardening foam, or it can be bake welded, or glued on during manufacturing, or attached permanently with other well-known manufacturing methods.

Figure 7:
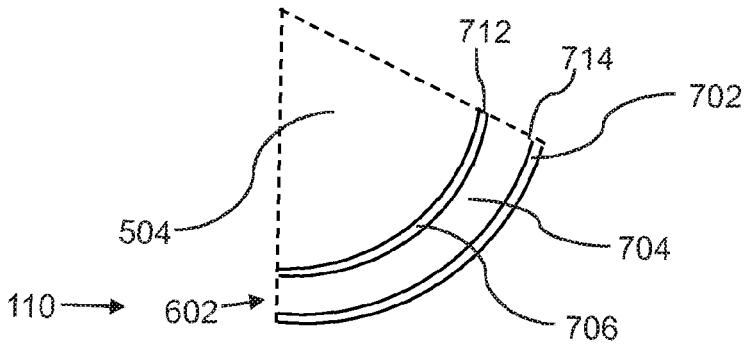
FIG. 7 is a cross-sectional centerline partial view of the neck of a stringed instrument manufactured with a back-side soft surface layer, showing a construction of the soft surface layer, according to an embodiment of the invention.

In further related embodiments, illustrated in FIG. 7, the soft surface layer 110 can be a composite construction made of an inner core soft material 704, such as a foam or synthetic rubber, and optionally an outer surface layer 702. The outer surface layer 702 can for example be made of vinyl or a thin leather. The inner core soft material 704 and the outer surface layer 702 can be bonded permanently together, for example with a permanent adhesive, such as a contact adhesive.

In related embodiments, the outer surface layer 702, can be a thin sheet of a flexible and relatively low friction material, such as for example a plastic or vinyl sheet, a vinyl adhesive tape, a thin leather sheet, silk, polyester or polycarbonate sheet, or other similar material, which can be laminated on to the inner core soft material 704, such that it is bonded permanently to the inner core soft material 704, for example using a permanent adhesive such as a contact adhesive. The outer surface layer 702 can also be a coating applied to the inner core soft material 704, such as for example a spray on clear coat, lacquer, paint or varnish, or a powder for bake-on or similar application. Well known suitable coatings can be similar to automotive paints used for plastic parts, such that the coating is sufficiently flexible, with a low friction medium-gloss or high-gloss composition. The thickness of the outer surface layer 702 can vary, but for most applications will be in a range from 0.1 to 1.5 mm. In related example embodiments, a flexible clear coat may be in the thinner/lower end of the range, while a vinyl sheet may typically be in the thicker/higher end of the range.

In a related embodiment, the outer surface layer 702 can be manufactured with a surface friction designed to be similar to the friction of the back-side surface of an instrument neck with a conventional high-gloss instrument varnish. For example, for a specific brand and model of a guitar the soft surface layer can be manufactured with a surface friction designed to match the specific surface friction of the guitar neck back-side matching the normal wood varnish friction. Alternatively, depending on preference, the surface friction of the outer surface layer 702 can be designed to be either lower or higher than a conventional instrument varnish.

In related embodiments, the inner core soft material 704 can be made of foam materials, natural or synthetic rubber, silicone, gel cushioning material, soft plastic, or other suitable soft material. Foam materials can include open or closed cell flexible polyurethane foam, memory foam, viscoelastic polyurethane foam, and similar foam materials. Foam materials can further include microcellular plastic foam, including flexible microcellular urethane foam and flexible microcellular polyurethane foam, with an average cell size in a range of 10-200 micrometer.

In a further related embodiment, the inner surface of the soft surface layer 110 can have an inner adhesive layer 706, to allow the soft surface layer 110 to adhere permanently to the neck body 504. The inner adhesive layer 706 can for example be a permanent adhesive, such as a contact adhesive.

Figure 3:
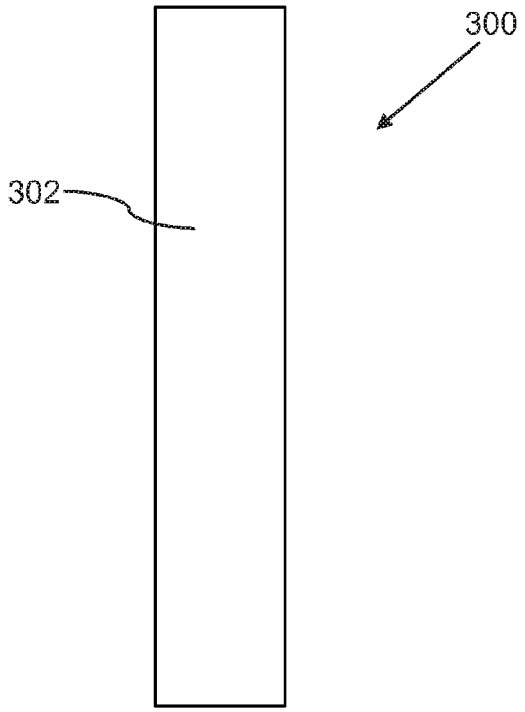
FIG. 3 is a top/front view of an installable soft surface component, according to an embodiment of the invention.
Figure 4:
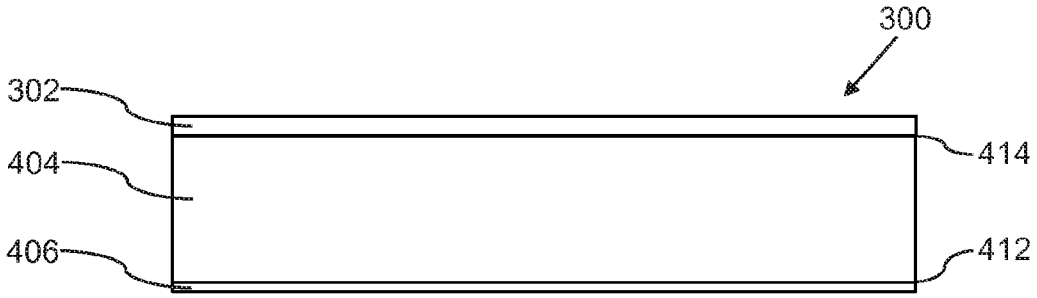
FIG. 4 is a cross-sectional centerline view of an installable soft surface component, according to an embodiment of the invention.

In a related embodiment, a stringed instrument can be retrofitted with an installable soft surface component 300, as illustrated in FIGS. 3, 4 and 5, which can be fitted on top of the surface of the neck back-side of a stringed instrument. The soft surface component 300 can be a sheet of a suitable soft material, and can further comprise an inner core soft material 404, with an adhesive inner surface 406, which is connected to an inner side 412 of the inner core soft material 404, to be applied to the surface of the back-side of a guitar neck, and an outer surface layer 302. The outer surface layer 302 is connected to an outer side 414 of the inner core soft material 404, and can for example be made of vinyl or a thin leather. The inner core soft material 404 and the outer surface layer 302 can be bonded permanently together, for example with a suitable permanent adhesive, such as a contact adhesive, or via heat bonding, or other bonding.

In related embodiments, the outer surface layer 302, can be a thin sheet of a flexible and relatively low friction material, such as for example a plastic or vinyl sheet, a vinyl adhesive tape, a thin leather sheet, a silk, polyester or polycarbonate sheet, or other similar material, which can be laminated on to the inner core soft material 404, such that it is bonded permanently to the inner core soft material 404, for example using a permanent adhesive such as a contact adhesive. The outer surface layer 302 can also be a coating applied to the inner core soft material 404, such as for example a spray on clear coat, lacquer, paint or varnish, or a powder for bake-on or similar application. Well known suitable coatings can be similar to automotive paints used for plastic parts, such that the coating is sufficiently flexible, with a low friction medium-gloss or high-gloss composition. The thickness of the outer surface layer 302 can vary, but for most applications will be in a range from 0.1 to 1.5 mm. In related example embodiments, a flexible clear coat may be in the thinner/lower end of the range, while a vinyl sheet may typically be in the thicker/higher end of the range.

In a related embodiment, the outer surface layer 302 can be manufactured with a surface friction designed to be similar to the friction of the back-side surface of an instrument neck with a conventional high-gloss instrument varnish. For example, for a specific brand and model of a guitar the soft surface layer can be manufactured with a surface friction designed to match the specific surface friction of the guitar neck back-side matching the normal wood varnish friction. Alternatively, depending on preference, the surface friction of the outer surface layer 302 can be designed to be either lower or higher than a conventional instrument varnish.

In related embodiments, the inner core soft material 404 can be made of foam materials, natural or synthetic rubber, silicone, gel cushioning material, soft plastic, or other similar soft material.

In a related embodiment, the adhesive feature of the soft surface component 300 can for example be obtained via an adhesive inner surface 406, which forms a thin adhesive layer, using a pressure sensitive adhesive, that allows for removal and repositioning, such as for example variants of adhesive that are used for stick-and-remove paper notes, or it can be achieved via a sticking feature inherent to the material of the inner core of the soft surface component 300, such can for example be the case with soft silicone materials, in which case there is no separate adhesive inner surface 406.

In a related embodiment, the adhesive inner surface 406, can be manufactured as a surface layer with micro-size suction cups, wherein each suction cup can be formed as a nano- or micro-size suction cup, or can be a an individual crater-like surface indentation, such that the overall effect is an adhesive that allows for removal and repositioning.

In a related embodiment, the adhesive inner surface 406 can employ a permanent adhesive, such as a contact adhesive, in order to provide a strong bond between the neck of the stringed instrument and the soft surface component 300, such that the soft surface component 300 will be difficult or impossible to remove after installation.

In a related embodiment, the adhesive inner surface 406 can cover only an area close to the edges of the inner surface of the soft surface component 300, such that an area of the inner surface away from the edges is not adhesive. As an example, such an adhesive inner surface 406 can be a strip with a width of 5-10 mm along the edges on the inner surface of the soft surface component.

In various embodiments, depending on application and the type of stringed instrument, the elasticity and hardness of a soft surface component 300 may allow for an indentation in the area of pressure from thumb or hands, normally in a range of 0.1 to 3 mm, during application of maximum force while playing on the stringed instrument. This range may vary according to preference and can be substantially wider, such as up to 6 mm or more. The indentation can for example be such that a soft surface component 300 can be compressed up to 25-95% or more of its thickness, during application of maximum force while playing on the stringed instrument, as compared to the normal thickness without application of force. A soft surface component 300 can for example be compressed up to 95%, such that a normal thickness of 3 mm is compressed down to 0.15 mm. The soft surface component 300 will for most applications substantially regain its original surface shape swiftly after application of force is ended on a localized area of the soft surface.

In related embodiment, the soft surface component 300 can be configured with a thickness in a range of 0.25-5 mm.

In various embodiments, the hardness of the soft surface component 300, as measured on the Shore durometer type O hardness scale, can be configured in the range of 8 to 84, which is a dimensionless scale in accordance with the ASTM D2240 Type O specification. A suitable hardness can vary according to preference, and may be lower or higher than this range.

In various embodiments, the hardness of the soft surface component 300, as measured on the Shore durometer type A hardness scale, can be configured in the range of 10 to 80, which is a dimensionless scale in accordance with the ASTM D2240 Type A specification. A suitable hardness can vary according to preference, and may be lower or higher than this range.

In various embodiments, durometer may be varied according to thickness of the soft surface component 300, such that a thinner soft surface component 300 can be configured with a harder inner core soft material 404, such that for example:

a. an inner core soft material 404 with a thickness in a range of 0.1 to 1.0 mm can be configured with a durometer type O hardness in a range of 35 to 75;
b. an inner core soft material 404 with a thickness in a range of 1.0 to 2.0 mm can be configured with a durometer type O hardness in a range of 14 to 42; and
c. an inner core soft material 404 with a thickness in a range of 2.0 to 3.0 mm can be configured with a durometer type O hardness in a range of 8 to 21.

In related embodiments, a soft surface component 300 can be configured with a gradually decreasing density of the inner core soft material 404, from an inner side 412 to an outer side 414, such that the inner core soft material 404 has a higher density on an inner side 412 and a lower density on an outer side 414.

In related embodiments, a soft surface component 300 can be configured with a gradually decreasing hardness of the inner core soft material 404, from an inner side 412 to an outer side 414, such that the inner core soft material 404 has a higher hardness on an inner side 412 and a lower hardness on an outer side 414.

In a further related embodiment, illustrated in FIG. 5, the installable soft surface component 300 can be fitted on top of the surface of the back-side of the neck 500 of a stringed instrument, after which strips of an adhesive tape 502 can optionally be applied to the sides of the installable soft surface component 300, in order to mask and secure the edges of the installable soft surface component 300. The adhesive tape 502 can for example be a form of plastic or vinyl tape, such as electric tape, with a color and texture to match the guitar neck materials. For some guitars, the color may for example be a suitable dark brown to match the color of a fingerboard surface construction manufactured in mahogany.

In a yet further related embodiment, the strips of adhesive tape 502 can be installed with a soft surface component 300 that does not have a an adhesive inner surface 406, whereby the strips of adhesive tape 502 can hold the soft surface component 300 in place on the back-side of the neck 208 of a stringed instrument, and additionally mask and secure the edges of the installable soft surface component 300.

In a further related embodiment, a stringed instrument can be retrofitted with an installable soft surface component 300, wherein the soft surface component 300 is sprayed on the surface of the back-side of a guitar neck, for example in the form of a hardening foam or rubber material. Such a spray-on application can for example be used to establish a relatively thin soft surface layer, with a thickness in the range of 0.01 mm to 6 mm.

In a related embodiment, the soft surface component 300 can be made in a predetermined general size, which can allow it to be cut to size, such that it can fit the backside of the neck of a specific stringed instrument. In an example, for use on guitars, such a predetermined general size can for example be 130 mm width by 460 mm length.

In a related embodiment, the soft surface component 300 can be made in a predetermined size to fit the backside of the neck of a specific make and model of a stringed instrument. This predetermined size can vary according to the specific make and model of the stringed instrument, and will often be less wide in one end, and wider in the opposite end in order to match a stringed instrument with a neck that widens as it reaches the instrument body.

In a further related embodiment, the soft surface component 300 can be made of elastic components, which can allow the soft surface component 300 to be stretched during installation in order to match it to the specific size and shape of the neck of the stringed instrument 102.

In a further related embodiment, the soft surface component 300 can be made with at least one tapered edge, such that the soft surface component 300 gradually becomes thinner at the tapered edge, whereby a height difference between the edge of the soft surface component 300 and the neck of a stringed instrument can be reduced, thereby allowing a more seamless installation of the soft surface component 300. For example, the soft surface component 300 can be made such that the two elongated edges, corresponding to the long sides of the soft surface component 300, are both tapered edges.

Figure 10:
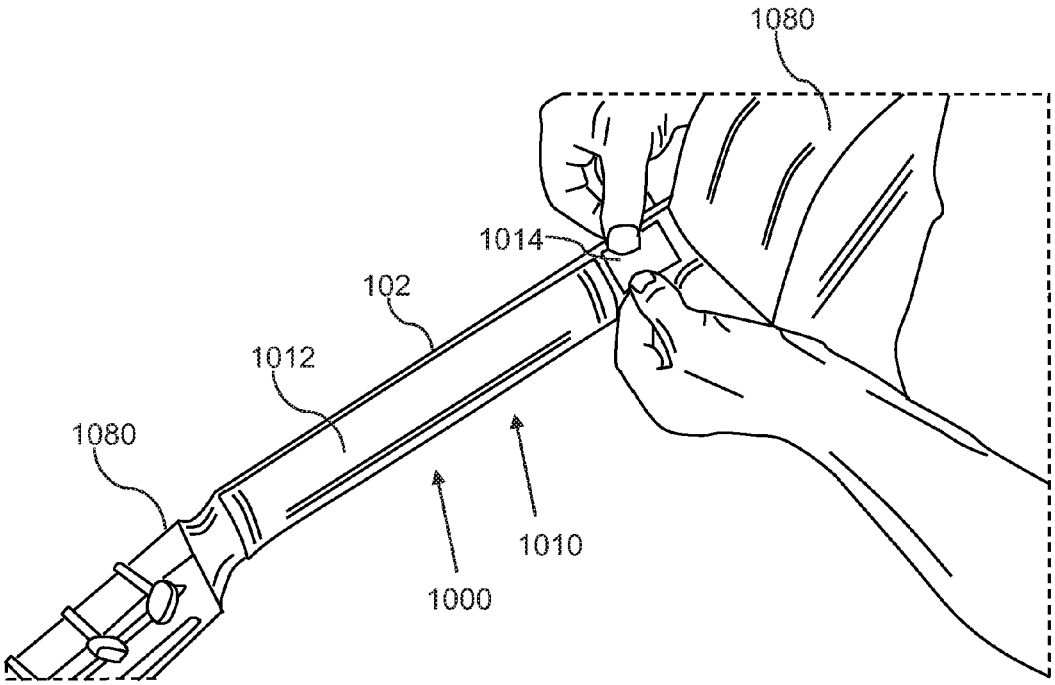
FIG. 10 is a perspective view of a soft surface component, comprising a plurality of pieces, during installation on a neck of stringed instrument, according to an embodiment of the invention.

In a related embodiment, such as shown in FIG. 10, the soft surface component 1000, can include a plurality of pieces 1010, such that the plurality of pieces 1010 are configured to be "puzzled in", i.e. laid in a pattern on the neck 102 of the stringed instrument 1080, to ensure coverage. FIG. 10 illustrates that a larger piece 1012 has been installed on the neck 102 and a smaller piece 1014 is being installed on the neck 102.

In a further related embodiment, a user can cut a one-piece soft surface component 300, into a plurality of pieces 1010 in preparation for mounting the one-piece soft surface component 300 on a stringed instrument 1080.

Figure 8:
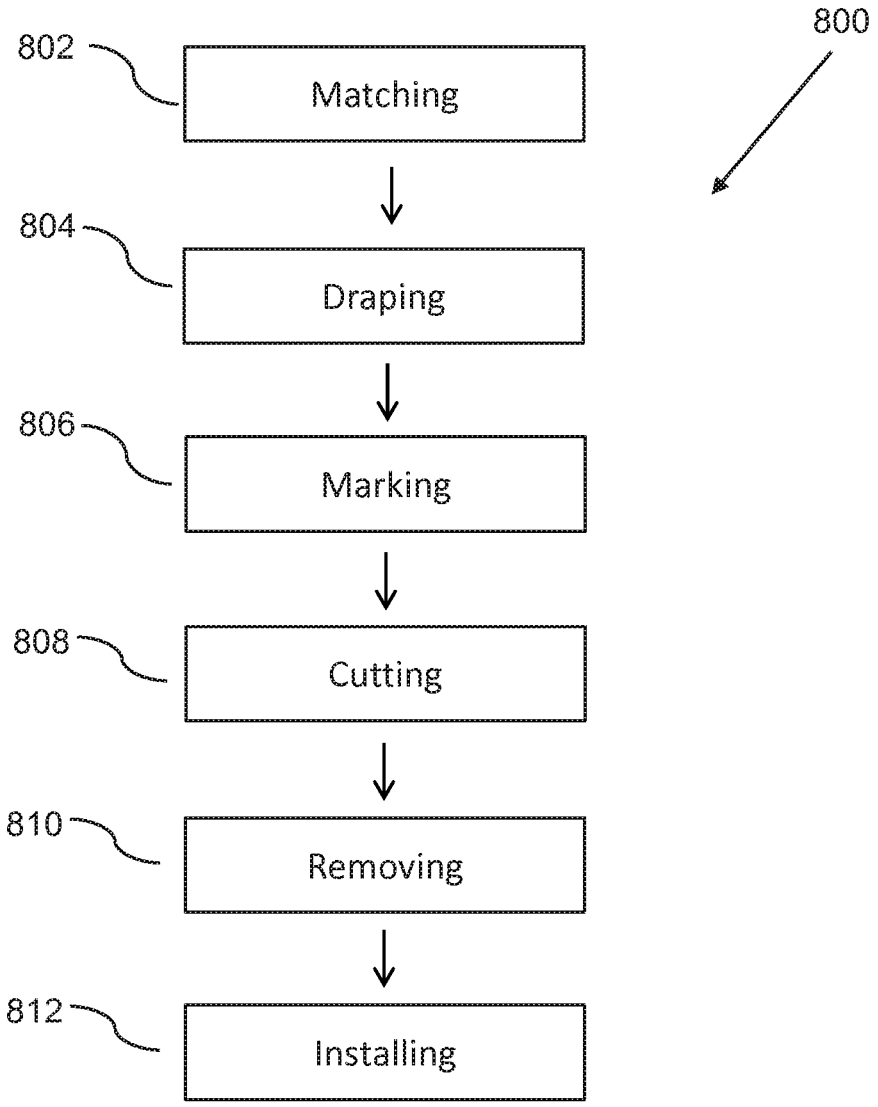
FIG. 8 is a flowchart illustrating steps that may be followed in accordance with one embodiment of a method for installing an installable soft surface component on the neck of a stringed instrument.

In an embodiment, illustrated in FIG. 8, a method for installing an installable soft surface component 300 on the neck of a stringed instrument 800 can comprise:

a. Matching 802 a first side of a sheet of an installable soft surface layer to the first side of the back of the neck of a stringed instrument;
b. Draping 804 the sheet along the back-side of the neck of the stringed instrument until it reaches the second side of the back of the neck of the stringed instrument;
c. Marking 806 a line on the sheet that indicates the match to the second side of the back of the neck;
d. Cutting 808 the sheet along the marked line;
e. Removing 810 a covering over an adhesive inner surface of the sheet;
f. Installing 812 the sheet on the back of the of the neck of the stringed instrument, by:
   i. matching the first side of the sheet with the first side of the back of the neck, so that the adhesive inner surface is against the outer surface of the neck;

ii. rolling the adhesive inner surface of the sheet over the neck from the first side to the second side, until the second side of the sheet matches the second side of the back of the neck.

Figure 9:
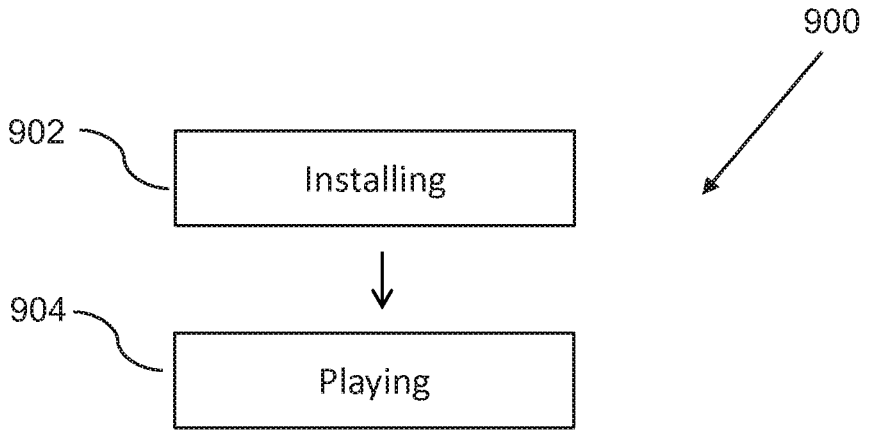
FIG. 9 is a flowchart illustrating steps that may be followed in accordance with one embodiment of a method for using a neck mounted soft surface layer with a stringed instrument.

In a related embodiment, illustrated in FIG. 9, a method for using a neck mounted soft surface layer with a stringed instrument 900 can comprise:

a. Installing 902 a soft surface layer on the neck of a stringed instrument;

b. Playing 904 on the stringed instrument;

Whereby an instrument player can reduce fatigue to the first hand, and the thumb of the first hand, and can prevent, reduce, or alleviate injury, during long-term playing on the stringed instrument.

In a further related embodiment, installing 902 the soft surface layer can be done during manufacturing of a stringed instrument with a soft surface neck.

In a further related embodiment, installing 902 the soft surface layer can be done as retrofitting of a stringed instrument, such that this step can follow the method for installing a soft surface component 300.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered to be fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A stringed instrument, wherein a neck of the stringed instrument comprises a soft surface layer, wherein the soft surface layer is configured with a shore durometer type o hardness in a range of 8-84, whereby the soft surface layer reduces fatigue in a first hand, including fingers and a thumb of the first hand, and prevents, reduces, or alleviates injury, during long-term use of the stringed instrument.

2. The stringed instrument of claim 1, wherein the soft surface layer covers a back-side of the neck of the stringed instrument.

3. The stringed instrument of claim 1, wherein the soft surface layer further comprises an inner core soft material and an outer surface layer.

4. The stringed instrument of claim 1, wherein the soft surface layer further comprises an inner adhesive layer.

5. The stringed instrument of claim 1, wherein the soft surface layer is configured with a thickness in a range of 0.01-40 mm.

6. The stringed instrument of claim 1, wherein the soft surface layer further comprises an inner core soft material, which is configured with a thickness in a range of 1.0-2.0 mm and a shore durometer type o hardness in a range of 14-42.

7. The stringed instrument of claim 1, wherein the soft surface layer further comprises an inner core soft material, such that the inner core soft material is configured with a gradually decreasing hardness, from an inner side of the inner core soft material to an outer side of the inner core soft material.

8. The stringed instrument of claim 1, wherein the soft surface layer further comprises an inner core soft material, such that the inner core soft material is configured with a gradually decreasing density, from an inner side of the inner core soft material to an outer side of the inner core soft material.

9. A soft surface component for installing on a back-side of a neck of a stringed instrument, wherein the soft surface component is configured to be retrofitted on a stringed instrument, such that the soft surface component is positioned on the back-side of the neck of the stringed instrument;

wherein the soft surface component is configured with a shore durometer type o hardness in a range of 8-84;

whereby the soft surface layer reduces fatigue to a first hand, and a thumb of the first hand, and prevents, reduces, or alleviates injury, during a user's long-term use of the stringed instrument retrofitted with the soft surface component.

10. The soft surface component of claim 9, further comprising:

a) an inner core soft material; and b) an adhesive inner surface;

wherein the adhesive inner surface is applied to an inner surface of the inner core soft material, whereby the adhesive inner surface is configured to stick to an outer surface of the back-side of the neck of the stringed instrument.

11. The soft surface component of claim 9, further comprising an outer surface layer, wherein the outer surface layer is permanently bonded to the inner core soft material.

12. The soft surface component of claim 9, wherein the soft surface component is configured with a thickness in a range of 0.25-5 mm.

13. The soft surface component of claim 9, further comprising an inner core soft material, which is configured with a thickness in a range of 0.1-1 mm and a shore durometer type o hardness in a range of 35-75.

14. The soft surface component of claim 9, further comprising an inner core soft material, which is configured with a thickness in a range of 1-2 mm and a shore durometer type o hardness in a range of 14-42.

15. The soft surface component of claim 9, further comprising an inner core soft material, which is configured with a thickness in a range of 2-3 mm and a shore durometer type o hardness in a range of 8-21.

16. The soft surface component of claim 9, wherein the soft surface component further comprises a plurality of pieces, such that the plurality of pieces are configured to be laid in a pattern on the neck of the stringed instrument.

17. A method of using a neck mounted soft surface layer with a stringed instrument, comprising:

a) installing a soft surface layer on a neck of the stringed instrument;

b) playing on the stringed instrument;

wherein the soft surface layer is configured with a shore durometer type o hardness in a range of 8-84;

whereby an instrument player reduces fatigue to a first hand, and a thumb of the first hand, and prevents, reduces, or alleviates injury, during long-term playing on the stringed instrument.

18. The method of using a neck mounted soft surface layer with a stringed instrument of claim 17, wherein installing the soft surface layer on the neck of the stringed instrument further comprises installing the soft surface layer on a back-side of the neck of the stringed instrument.

19. The method of using a neck mounted soft surface layer with a stringed instrument of claim 17, wherein the soft surface layer is configured with a thickness in a range of 0.01-40 mm.

20. The method of using a neck mounted soft surface layer with a stringed instrument of claim 17, wherein the soft surface layer further comprises an inner core soft material, which is configured with a thickness in a range of 1.0-2.0 mm and a shore durometer type o hardness in a range of 14-42.

* * * * *